US009986888B2

(12) United States Patent
Kumar et al.

(10) Patent No.: US 9,986,888 B2
(45) Date of Patent: Jun. 5, 2018

(54) DISHWASHER RACK LIFT MECHANISM

(71) Applicant: General Electric Company, Schenectady, NY (US)

(72) Inventors: Shree Kumar, Bangalore (IN); Justin Tyler Brown, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 243 days.

(21) Appl. No.: 15/001,353

(22) Filed: Jan. 20, 2016

(65) Prior Publication Data

US 2017/0202428 A1 Jul. 20, 2017

(51) Int. Cl.

| | |
|---|---|
| ***A47L 15/50*** | (2006.01) |
| ***A47L 15/42*** | (2006.01) |
| ***A47L 15/23*** | (2006.01) |

(52) U.S. Cl.

CPC ..... *A47L 15/506* (2013.01); *A47L 15/23* (2013.01); *A47L 15/4221* (2013.01); *A47L 15/4259* (2013.01); *A47L 15/4261* (2013.01); *A47L 15/4293* (2013.01); *A47L 15/502* (2013.01); *A47L 15/507* (2013.01)

(58) Field of Classification Search

CPC ..... A47L 15/506

See application file for complete search history.

(56) References Cited

U.S. PATENT DOCUMENTS

| | | | | |
|---|---|---|---|---|
| 6,247,771 | B1 | 6/2001 | Miller | |
| 8,303,053 | B2 | 11/2012 | Bond et al. | |
| 2003/0042825 | A1* | 3/2003 | Welch | A47L 15/504 312/228.1 |
| 2004/0163687 | A1 | 8/2004 | Son et al. | |

FOREIGN PATENT DOCUMENTS

WO WO 2014/102367 A1 7/2014

* cited by examiner

*Primary Examiner* — Jason Ko

(74) *Attorney, Agent, or Firm* — Dority & Manning, P.A.

(57) ABSTRACT

A rack lifting assembly for a dishwasher appliance is provided. The rack lifting assembly includes frame having rotatably mounted wheels to enable the frame to be rolled in and out of the wash chamber of the dishwasher appliance. A lower rack may be operably coupled to the frame by a pulley system including a rope winding between a first set of pulleys mounted to the frame and a second set of pulleys mounted to the lower rack. A retracting means, such as a motor, may wind and unwind a rope of the pulley system to move the lower rack vertically within the frame. Linear slides are mounted on the left and right sides of the frame to guide the lower rack, thereby keeping it in a horizontal orientation while lifting.

11 Claims, 11 Drawing Sheets

DISHWASHER RACK LIFT MECHANISM

FIELD OF THE INVENTION

The subject matter of the present disclosure relates generally to a dishwasher, and more particularly, to a system for lifting a lower rack of a dishwasher appliance.

BACKGROUND OF THE INVENTION

Dishwasher appliances generally include a tub that defines a wash chamber. Rack assemblies can be mounted within the wash chamber of the tub for receipt of articles for washing. Spray assemblies within the wash compartment can apply or direct wash fluid towards articles disposed within the rack assemblies in order to clean such articles. Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment. Other configurations may be used as well.

Typically, the lower rack of a dishwasher is pulled out for loading and unloading of dishes. A dishwasher door pivots into an open, horizontal position and may define a surface having one or more tracks for receiving wheels rotatably mounted on the lower rack. The lower rack is rolled out of the tub onto the open dishwasher door to simplify the loading or unloading process, e.g., by not requiring a user to reach into the wash chamber to add or remove dishes. However, even when the rack is extended outside the wash chamber, consumers must often bend over to reach the dishes located in the lower rack, resulting in discomfort and ergonomic issues. While some dishwashers have incorporated means for lifting the lower rack, these mechanisms often lift the lower rack in a jerky and non-uniform manner. Alternatively, these systems are complex, expensive, and difficult to maintain.

Accordingly, a dishwashing appliance having a system for lifting the lower rack when loading or unloading dishes would be useful. More particularly, a cost effective rack lifting system that may lift the lower rack in a smooth and uniform manner to provide a simple, ergonomic method of loading and unloading dishes would be especially beneficial.

BRIEF DESCRIPTION OF THE INVENTION

The present invention provides a rack lifting assembly for a dishwasher appliance. The rack lifting assembly includes frame having rotatably mounted wheels to enable the frame to be rolled in and out of the wash chamber of the dishwasher appliance. A lower rack may be operably coupled to the frame by a pulley system including a rope winding between a first set of pulleys mounted to the frame and a second set of pulleys mounted to the lower rack. A retracting means, such as a motor, may wind and unwind a rope of the pulley system to move the lower rack vertically within the frame. Linear slides are mounted on the left and right sides of the frame to guide the lower rack, thereby keeping it in a horizontal orientation while lifting. In this manner, the lower rack of a dishwasher appliance may be raised in a smooth and uniform manner to simplify loading or unloading dishes. Additional aspects and advantages of the invention will be set forth in part in the following description, may be apparent from the description, or may be learned through practice of the invention.

In one exemplary embodiment, a dishwasher appliance defining a vertical, a lateral, and a transverse direction is provided. The dishwasher appliance includes a wash tub that defines a wash chamber; a fluid circulation assembly for providing a fluid flow for cleaning articles placed within the wash chamber; and a lower rack lifting assembly. The lower rack lifting assembly includes a frame slidably positioned within the wash chamber and configured for movement along the transverse direction between a first position where the frame is within the wash chamber and a second position where the frame is positioned outside the wash chamber. The lower rack lifting assembly further includes a lower rack configured for receipt of the articles for washing; a first set of pulleys rotatably mounted to the frame; and a second set of pulleys rotatably mounted to the lower rack. A rope passes between the first set of pulleys and the second set of pulleys to operably couple the lower rack to the frame, the rope having a first end fixed to the frame and an opposite second end. A retracting means is configured for retracting the second end of the rope to move the lower rack vertically within the frame.

In another exemplary embodiment, a rack lifting assembly for a dishwasher appliance defining a vertical, a lateral, and a transverse direction is provided. The rack lifting assembly includes a frame slidably positioned within a wash chamber of the dishwasher appliance; a lower rack configured for receipt of articles for washing; and a pulley assembly. The pulley assembly includes a first set of pulleys rotatably mounted to the frame and a second set of pulleys rotatably mounted to the lower rack. A rope having a first end and a second end winds between the first set of pulleys and the second set of pulleys and the first end is fixed to the frame. A motor is configured for retracting the second end of the rope to cause the lower rack to lift within the frame.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
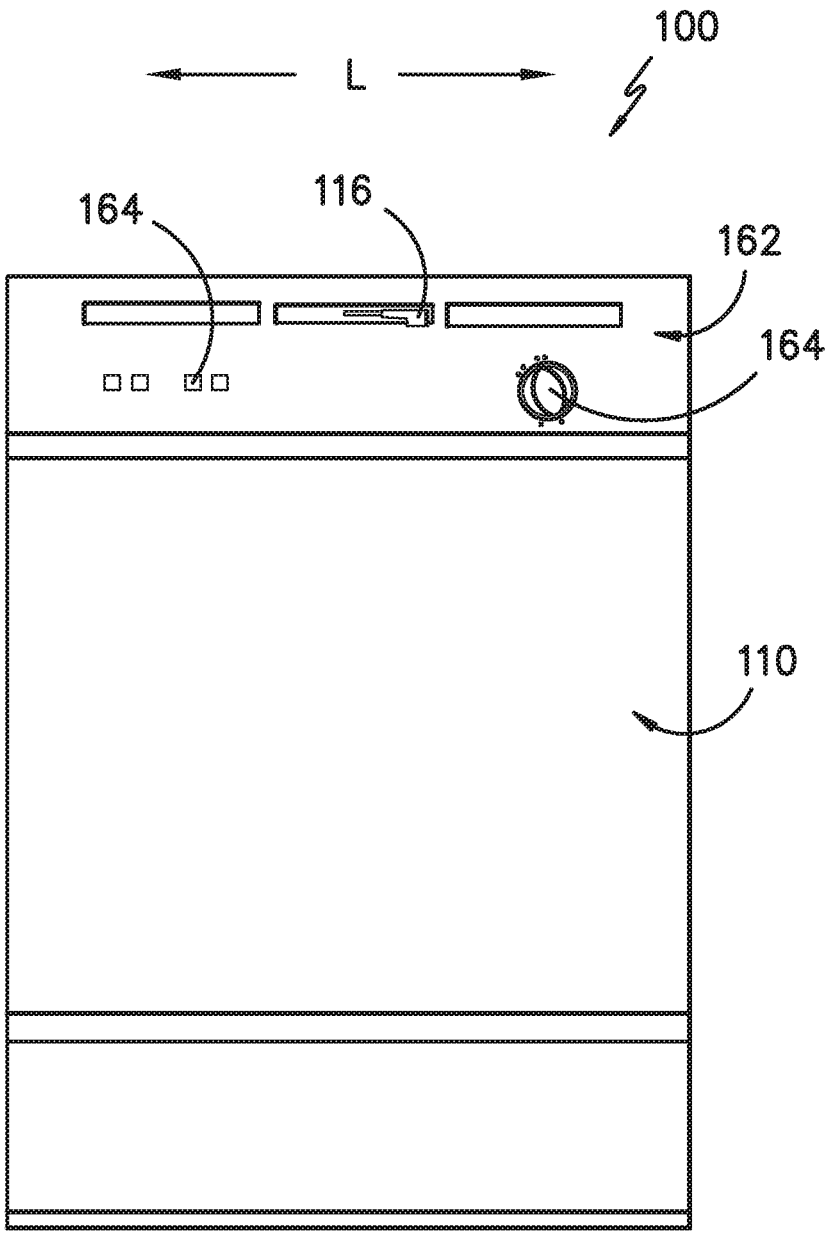
FIG. 1 provides a front view of a dishwashing appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments. The use of the terms "top" and "bottom," or "upper" and "lower" herein are used for reference only as exemplary embodiments disclosed herein are not limited to the vertical orientation shown nor to any particular configuration shown; other constructions and orientations may also be used.

Figure 2:
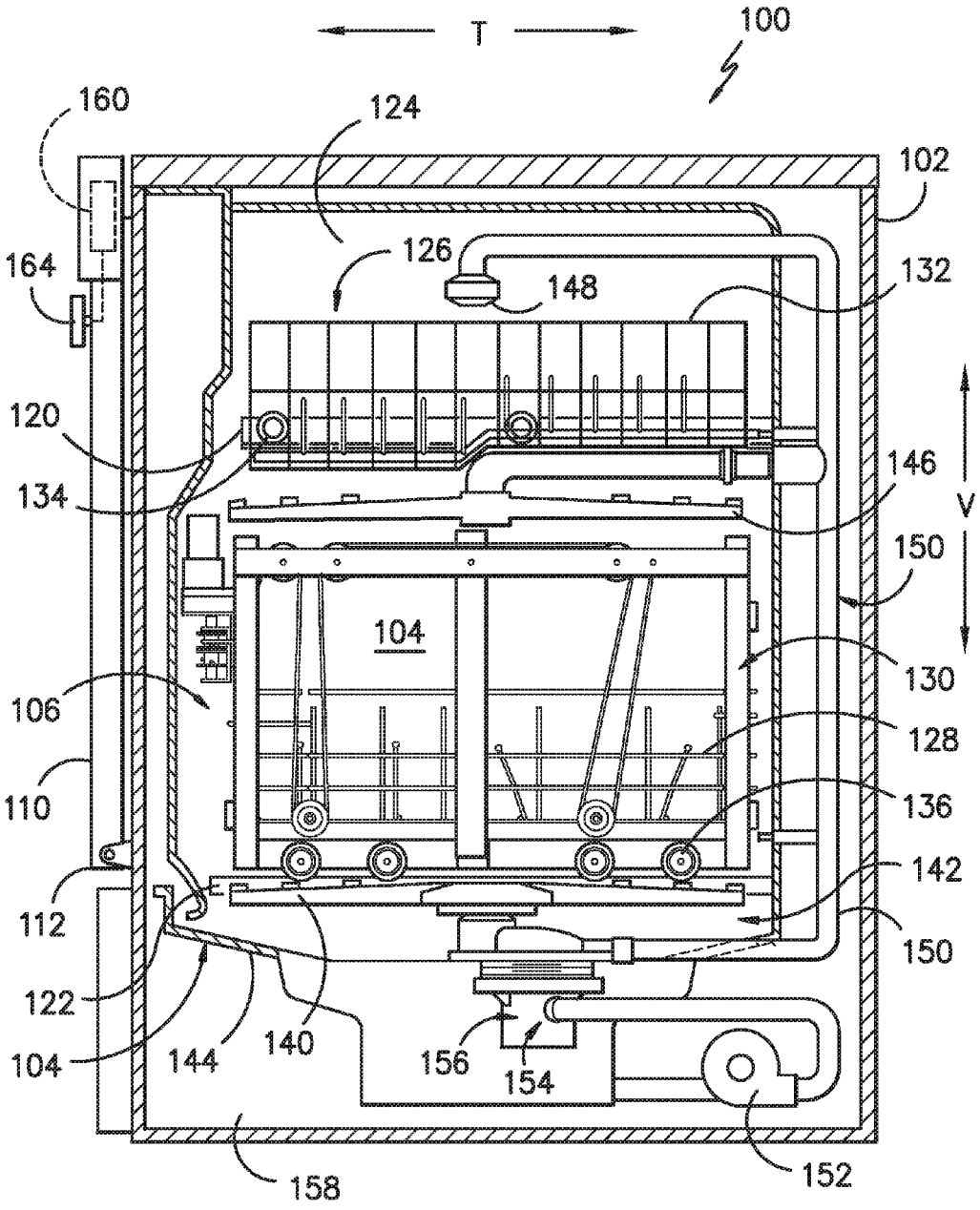
FIG. 2 provides a side cross sectional view of the exemplary dishwashing appliance of FIG. 1.
Figure 3:
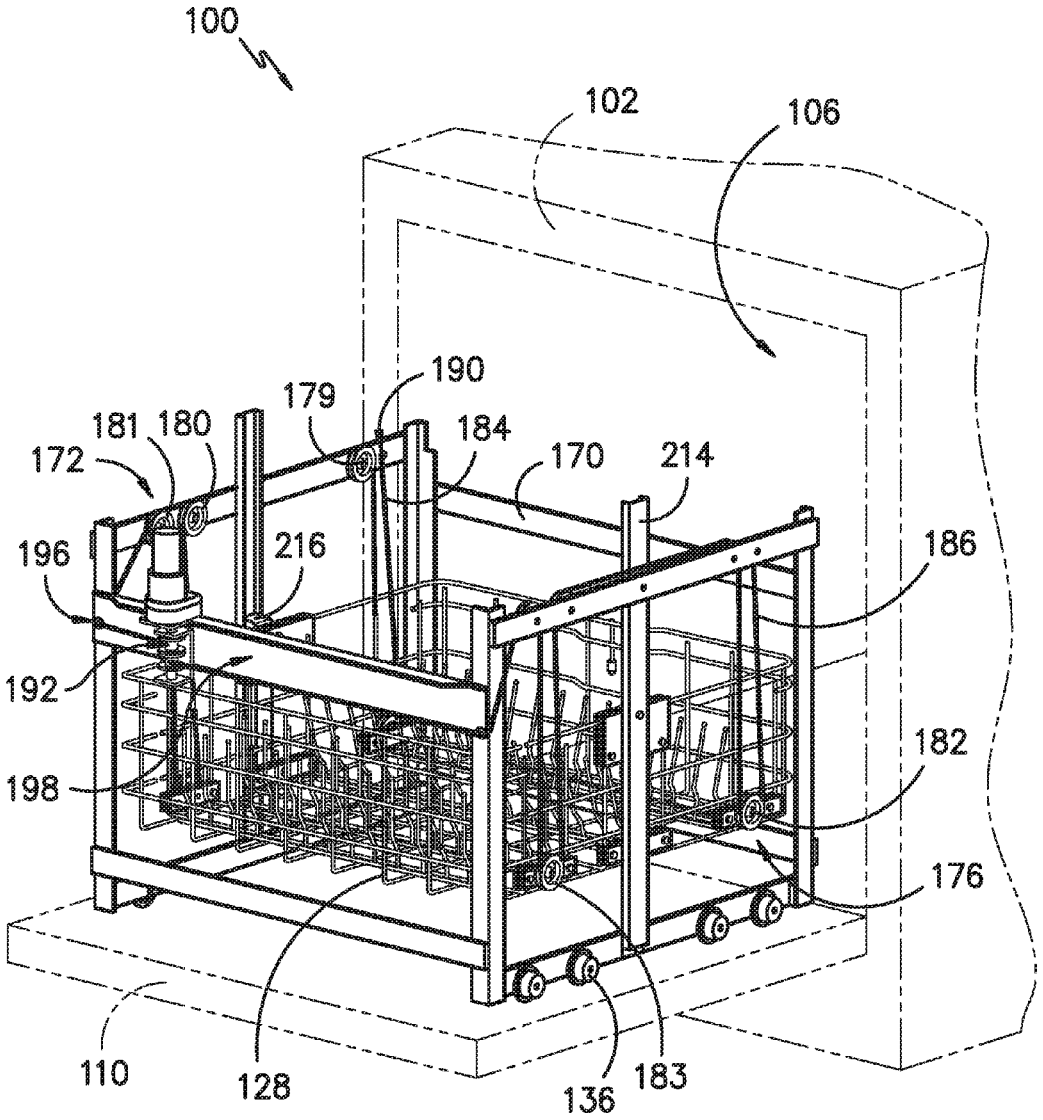
FIG. 3 provides a perspective view of a rack lifting assembly according to an exemplary embodiment of the present subject matter, with the dishwashing appliance shown in phantom and the lower rack in the lowered position.
Figure 4:
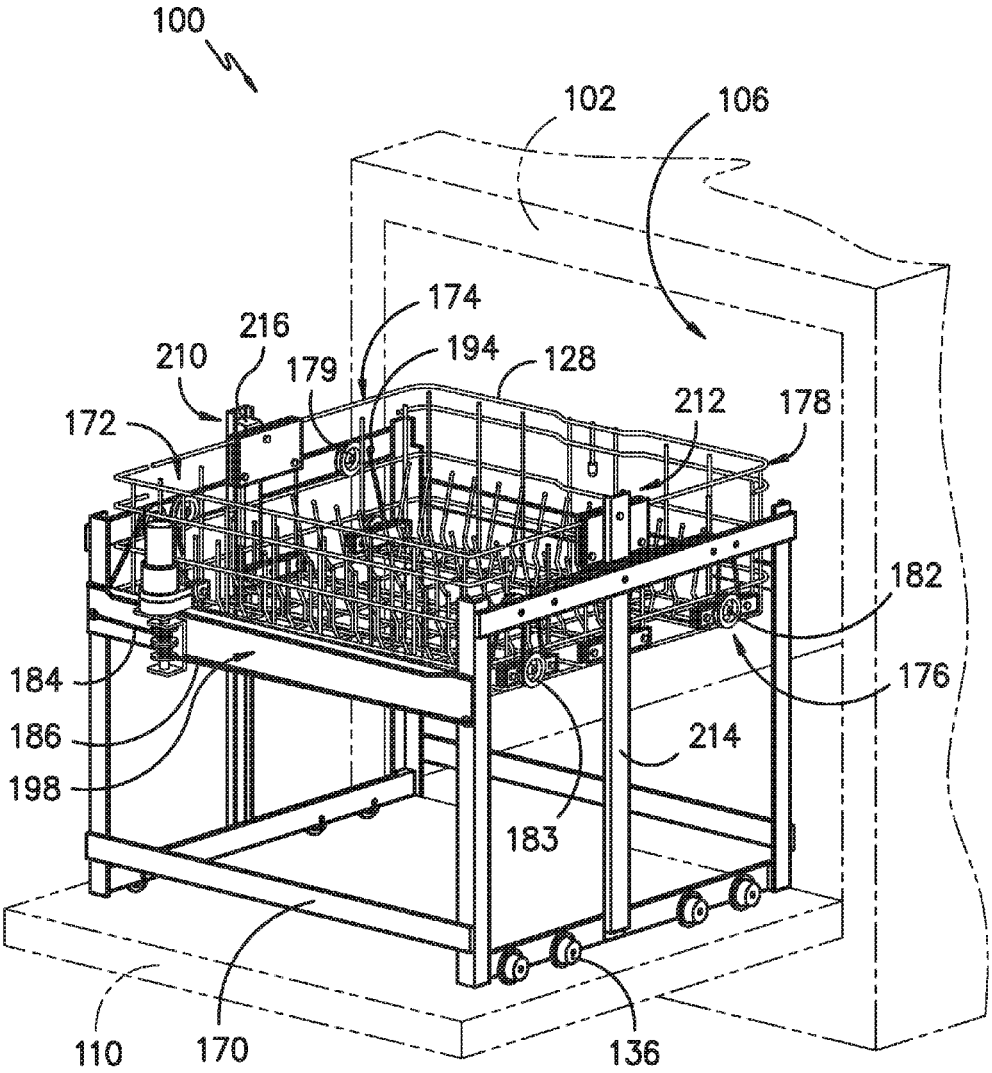
FIG. 4 provides a perspective view of the exemplary rack lifting assembly of FIG. 3, with the dishwashing appliance shown in phantom and the lower rack in the raised position.
Figure 5:
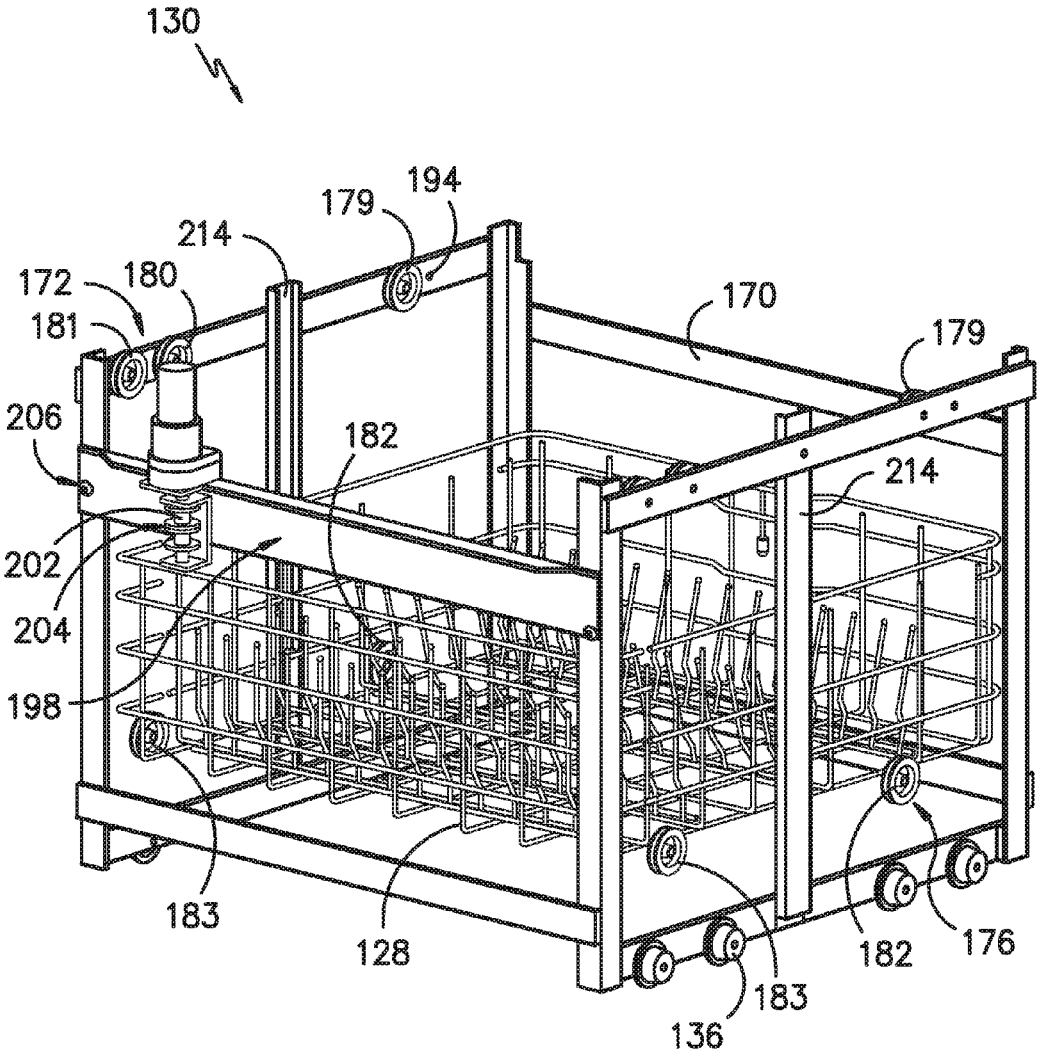
FIG. 5 provides a perspective view of the exemplary rack lifting assembly of FIG. 3, with the lower rack in a lowered position and a pulley rope removed for clarity.
Figure 6:
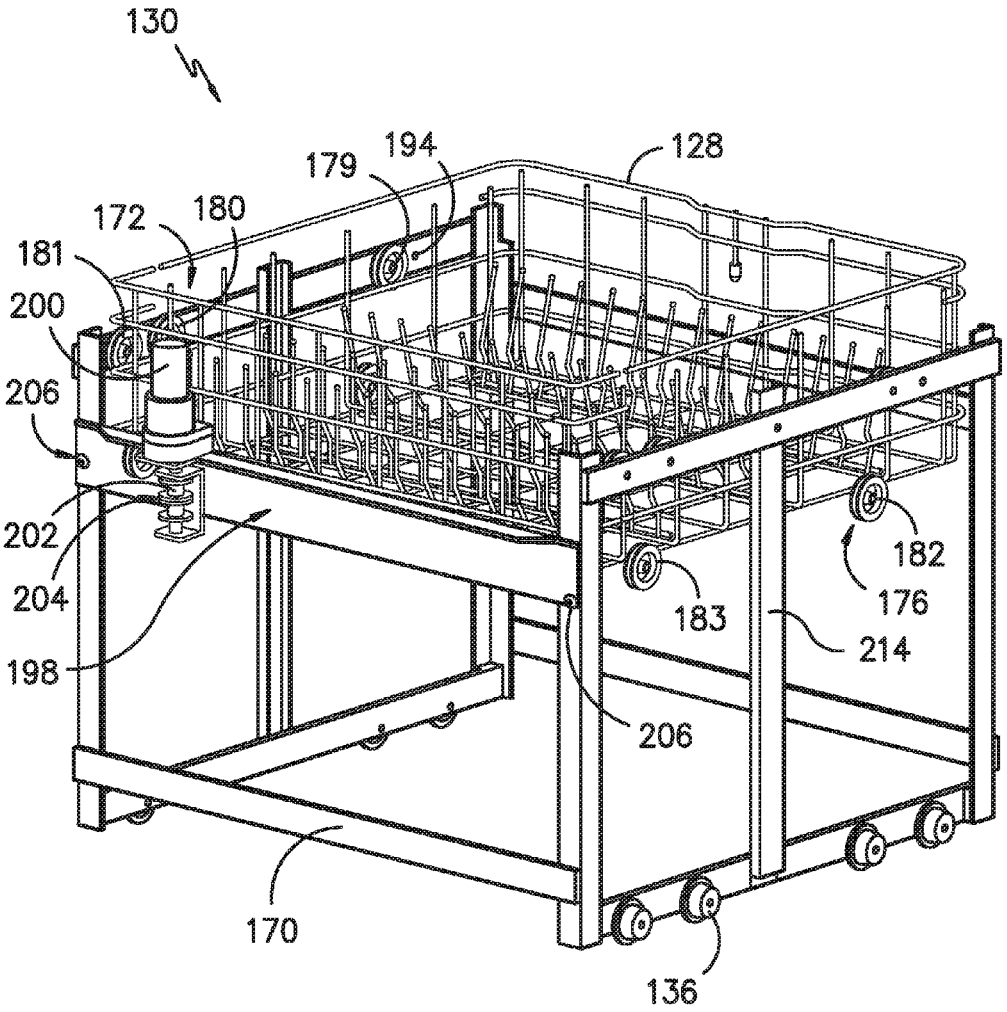
FIG. 6 provides a perspective view of the exemplary rack lifting assembly of FIG. 3, with the lower rack in a raised position and the pulley rope removed for clarity.
Figure 7:
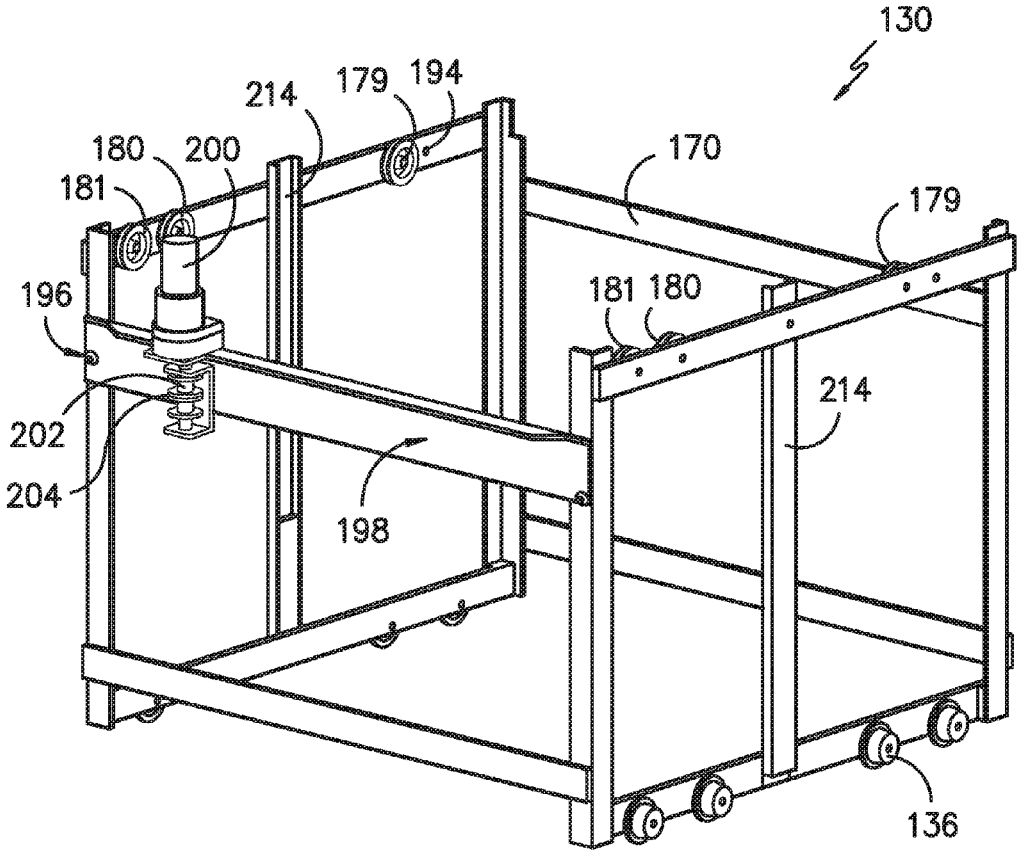
FIG. 7 provides a perspective view of the exemplary rack lifting assembly of FIG. 3, with the lower rack removed for clarity.
Figure 8:
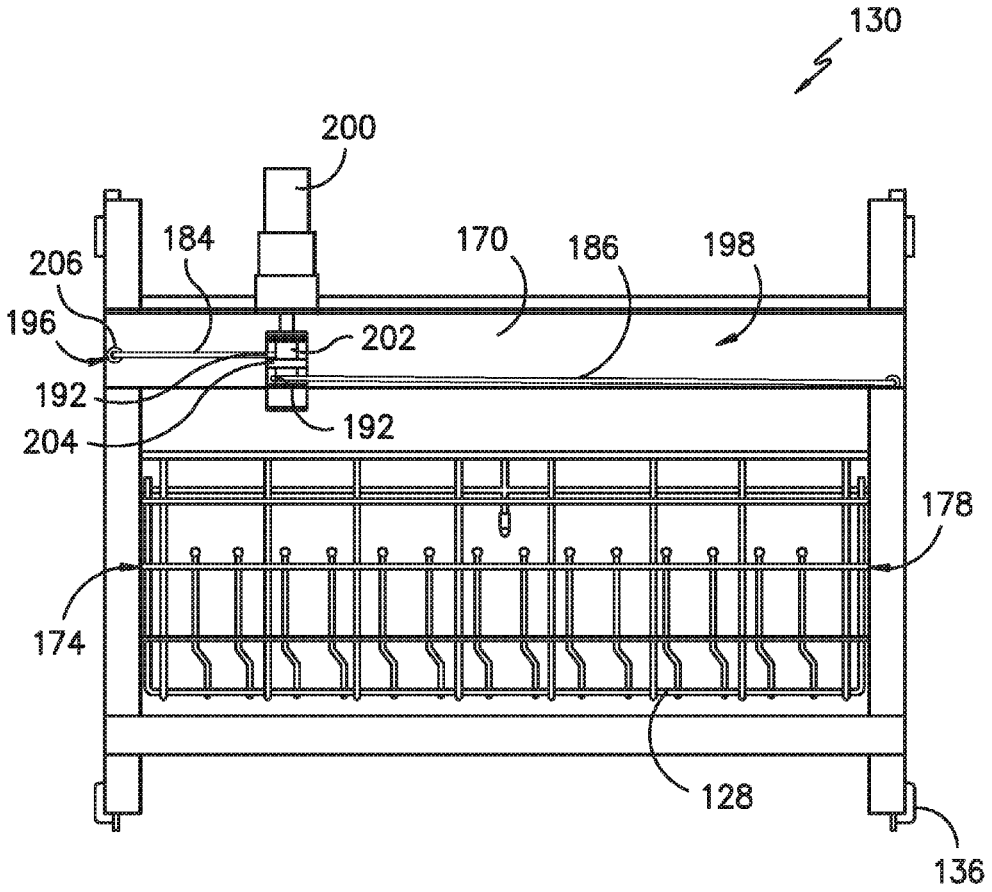
FIG. 8 provides a front view of the exemplary rack lifting assembly of FIG. 3.
Figure 9:
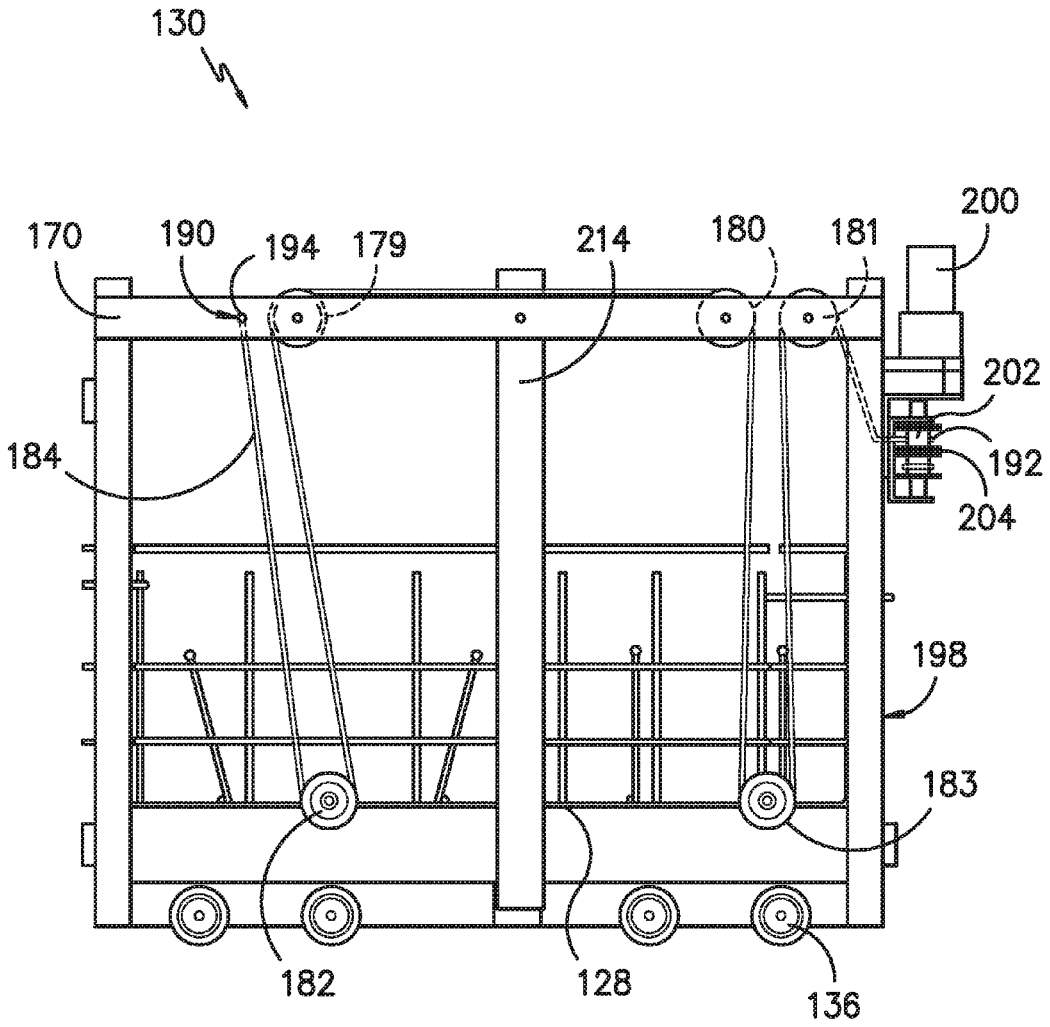
FIG. 9 provides a side view of the exemplary rack lifting assembly of FIG. 3.
Figure 10:
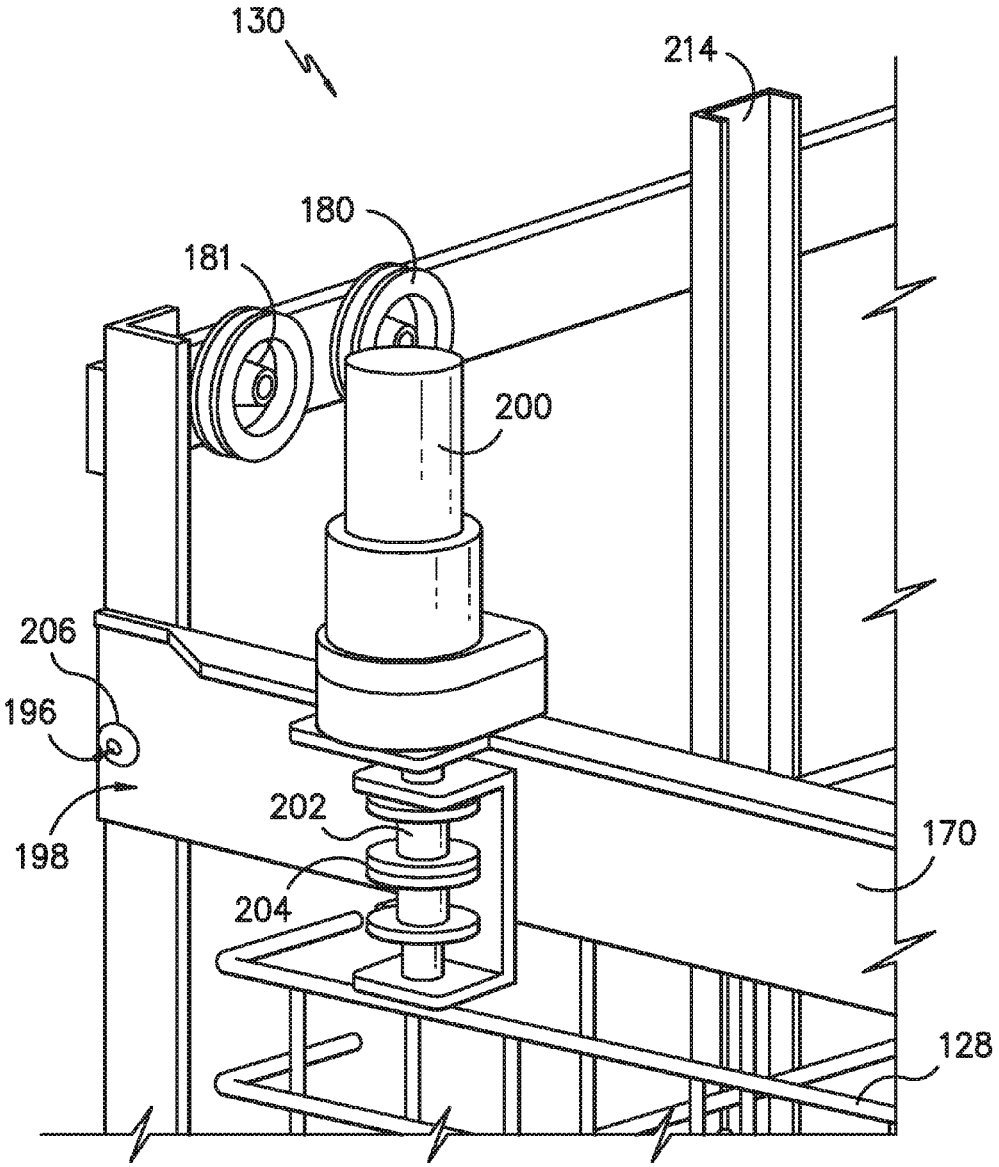
FIG. 10 provides a close up perspective view of a motor for winding the pulley rope of the exemplary rack lifting assembly of FIG. 3.

FIGS. 1 and 2 depict an exemplary domestic dishwasher 100 that may be configured in accordance with aspects of the present disclosure. Dishwasher 100 generally defines a vertical direction V, a lateral direction L, and a transverse direction T, each of which is mutually perpendicular, such that an orthogonal coordinate system is generally defined. For the particular embodiment of FIGS. 1 and 2, the dishwasher 100 includes a cabinet 102 having a tub or inner liner 104 therein that defines a wash chamber 106. The tub 104 includes a front opening (not shown) and a door 110 hinged at its bottom 112 for movement between a normally closed vertical position (shown in FIGS. 1 and 2), wherein the wash chamber 106 is sealed shut for washing operation, and a horizontal open position for loading and unloading of articles from the dishwasher 100. Latch 116 is used to lock and unlock door 110 for access to wash chamber 106.

Upper and lower guide rails 120, 122 are mounted on tub side walls 124 and accommodate roller-equipped rack assemblies. More specifically, according to the illustrated exemplary embodiment, upper rack assembly 126 is slidably received on upper guide rails 120. As will be discussed in detail below, lower rack 128 is received within a rack lifting assembly 130. Each of upper rack 126 and lower rack 128 is fabricated into lattice structures including a plurality of elongated members 132 (for clarity of illustration, not all elongated members making up upper rack 126 and lower rack 128 are shown in FIG. 2). Each rack 126, 128 is adapted for movement between an extended loading position (not shown) in which the rack is substantially positioned outside the wash chamber 106, and a retracted position (shown in FIGS. 1 and 2) in which the rack is located inside the wash chamber 106. For upper rack 126, this movement is facilitated by rollers 134. As will be described in more detail below, rack lifting assembly 130 may move between the extended and retracted position using rollers or wheels 136. A silverware basket (not shown) may be removably attached to lower rack 128 for placement of silverware, utensils, and the like, that are otherwise too small to be accommodated by the racks 126, 128.

The dishwasher 100 further includes a lower spray-arm assembly 140 that is rotatably mounted within a lower region 142 of the wash chamber 106 and above a tub sump portion 144 so as to rotate in relatively close proximity to lower rack 128. A mid-level spray-arm assembly 146 is located in an upper region of the wash chamber 106 and may be located in close proximity to upper rack 126. Additionally, an upper spray assembly 148 may be located above the upper rack 126.

The lower, mid-level, and upper spray-arm assemblies 140, 146, and 148 are part of a fluid circulation assembly 150 for circulating water and dishwasher fluid in the tub 104. The fluid circulation assembly 150 also includes a pump 152 positioned in a machinery compartment 158 located below the tub sump portion 144 (i.e., bottom wall) of the tub 104, as generally recognized in the art. Pump 152 receives fluid from sump 144 and provides a flow to the inlet 154 of a diverter 156. Diverter 156 can be used to selectively place pump 152 in fluid communication with spray assemblies 140, 146, or 148 by way of various outlet ports (not shown). Other spray assemblies and connection configurations may be used as well.

Each spray-arm assembly 140, 146 includes an arrangement of discharge ports or orifices for directing washing liquid received from diverter 156 onto dishes or other articles located in rack assemblies 126 and 128. The arrangement of the discharge ports in spray-arm assemblies 140, 146 provides a rotational force by virtue of washing fluid flowing through the discharge ports. The resultant rotation of the spray-arm assemblies 140, 146 and the operation of spray assembly 148 using fluid from diverter 156 provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

Each spray assembly may receive an independent stream of fluid, may be stationary, and/or may be configured to rotate in one or both directions. For example, a single spray arm may have multiple sets of discharge ports, each set receiving wash fluid from a different fluid conduit, and each set being configured to spray in opposite directions and impart opposite rotational forces on the spray arm. In order to avoid stalling the rotation of such a spray arm, wash fluid is typically only supplied to one of the sets of discharge ports at a time.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 160 may be positioned in a variety of locations throughout dishwasher 100. In the illustrated embodiment, the controller 160 may be located within a control panel area 162 of door 110 as shown in FIGS. 1 and 2. In such an embodiment, input/output ("I/O") signals may be routed between the control system and various operational components of dishwasher 100 along wiring harnesses that may be routed through the bottom 112 of door 110. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for racks 126, 128, different spray arm assemblies 140, 146, 148 may be used, and other differences may be applied as well.

Referring now generally to FIGS. 3-11, lower rack lifting assembly 130 will be described in more detail. According to an exemplary embodiment, lower rack lifting assembly 130 may include a frame 170. Frame 170 may be made out of any suitably rigid material, e.g., aluminum, stainless steel, plastic, etc. In addition, frame 170 may be constructed from a sheet of material with suitable cut-outs, or it may be made from multiple flat pieces which are connected by welding or using mechanical fasteners, e.g., bolts or rivets. Other suitable constructions and configurations of frame 170 are possible and within the scope of the present subject matter.

Frame 170 is slidably positioned within wash chamber 106 and configured for movement along transverse direction T between a first, retracted position where frame 170 is within wash chamber 106 and a second, extended position where frame 170 is positioned outside wash chamber 106. For example, as mentioned above, lower guide rails 122 are mounted on tub side walls 124 to accommodate rack lifting assembly 130. In this regard, frame 170 may include a set of wheels, such as lower rack rollers 136, rotatably mounted to the bottom of frame 170 to support rack lifting assembly 130 and enable it to roll in and out of the tub 104. In the extended position, rack lifting assembly 130 may sit on door 110 when it is in the open, horizontal position. In addition, because rack lifting assembly 130 rolls freely on lower rack rollers 136, it may be completely removable from dishwasher 100.

Lower rack 128 may be adjustably mounted within frame 170, such that it is vertically adjustable. In this regard, lower rack 128 may be mounted to frame 170 using one or more pulley systems, each of which may include one or more pulleys and one or more pulley ropes. More particularly, according to the illustrated embodiment, a first pulley system 172 may be operably coupled with a first side 174 (see FIG. 8) of lower rack 128 and a second pulley system 176 may be operably coupled with a second side 178 (see FIG. 8) of lower rack 128. Pulley systems 172, 176 may be operated simultaneously to raise first side 174 and second side 178 of lower rack 128 within frame 170, as will be described below.

For example, according to the illustrated embodiment, first pulley system 172 may have three frame pulleys rotatably mounted on frame 170 and two rack pulleys be rotatably mounted on first side 174 of lower rack 128. More specifically, frame 170 may include an upper frame member extending along the transverse direction T from the front of frame 170 to the back of frame 170. A first frame pulley 179, a second frame pulley 180, and a third frame pulley 181 may be rotatably mounted on the inside surface of the upper frame member such that they face the interior of frame 170. In order to balance the load of lower rack 128, first frame pulley 179 may be mounted on the upper frame member proximate the back of frame 170 and second and third frame pulleys 180, 181 may be mounted on the upper frame member proximate the front of frame 170. Further, second and third frame pulleys 180, 181 may be mounted close to each other so that a first rope 184 maintains a substantially vertical orientation when it is passed through first pulley system 172.

A first rack pulley 182 and a second rack pulley 183 may be rotatably mounted on first side 174 of lower rack 128. More specifically, rack pulleys 182, 183 may be mounted to an exterior surface of lower rack 128 using any suitable bracket or mounting feature. According to the illustrated embodiment, in order to balance the load of lower rack 128, first rack pulley 182 is mounted proximate the back side of lower rack 128 and second rack pulley 183 is mounted proximate the front side of lower rack 128. Notably, when lower rack 128 is installed in rack lifting assembly 130 using pulley systems 172, 176, frame pulleys 179, 180, 181 should be positioned in substantially the same vertical plane as rack pulleys 182, 183. In this manner, first rope 184 may maintain a substantially vertical orientation while lower rack 128 is being lifted, as described below.

First rope 184 may pass between frame pulleys 179, 180, 181 and rack pulleys 182, 183 to operably couple lower rack 128 to frame 170. More specifically, first rope 184 (and a second rope 186) may have a first end 190 and a second end 192. First end 190 may be attached to frame 170 and second end 192 may be retracted or wound up in order to operate first pulley system 172. First end 190 may be attached to an attachment point 194 on the upper frame member of frame 170 by clinching, tying, or any other suitable method.

Attachment point 194 may be close to first frame pulley 179 so that first rope 184 maintains a substantially vertical orientation when installed in first pulley system 172.

According to the illustrated exemplary embodiment, from first end 190 to second end 192, first rope 184 may pass from attachment point 194 down to first rack pulley 182 then back up to first frame pulley 179. First rope 184 may then pass along a transverse direction to second frame pulley 180, back down to second rack pulley 183, then back up to third frame pulley 181 before passing through an aperture 196 in a front 198 of frame 170 to a retracting means, as described below. When first rope 184 is installed in first pulley system 172, the portions of first rope 184 extending between frame pulleys 179, 180, 181 and rack pulleys 182, 183 are preferably oriented substantially along the vertical direction V so that the tensile force of first rope 184 also is directed along the vertical direction V.

One skilled in the art will appreciate that the discussion above related to first pulley system 172 applies also to second pulley system 176, which may be configured and operated in a similar manner. For example, second pulley system 176 may include three frame pulleys 179, 180, 181 rotatably mounted to a second upper frame member, two rack pulleys 182, 183 rotatably mounted to lower rack 128, and a second rope 186. According to the illustrated embodiment, second pulley system 176 operates in the same manner as first pulley system 172, as described in detail below.

Operation of first pulley system 172 will now be described. In general, the retracting means may be any mechanism suitable for pulling one or more ropes 184, 186 in order to actuate pulley systems 172, 176. For example, according to one exemplary embodiment, retracting means may be a manual pull bar extending horizontally from the left side to the right side of frame 170. Second ends 192 of first rope 184 and second rope 186 may be fixed to the ends of the manual pull bar. By pulling the manual pull bar away from frame 170, pulley systems 172, 176 are actuated to lift lower rack 128 within frame 170. By pulling the manual pull bar directly in the transverse direction T away from frame 170, second ends 192 of first rope 184 and second rope 186 should be retracted at the same rate, thereby ensuring that the lower rack 128 is raised uniformly and maintains its horizontal orientation.

According to the illustrated embodiment, the retracting means may be a motor 200. Motor 200 may be vertically mounted to frame 170 and may drive a spool 202 for winding and unwinding first rope 184 and second rope 186. Motor 200 may be, for example, a geared electric motor or a hydraulic motor. Motor 200 may be powered directly from a power supply that is internal or external to dishwasher 100. For example, according to one embodiment, motor 200 may be powered via a retractable power cord. Alternatively, an electrical plug may be provided on frame 170 and an electrical socket may be suitably mounted on door 110. When door 110 is opened and frame 170 is rolled out of tub 104, the electrical plug docks on the electrical socket to establish an electrical connection and provide power to motor 200. According to yet another exemplary embodiment, motor 200 may be powered by a rechargeable battery mounted to frame 170. The battery may be removed for recharging outside dishwasher 100 or may be powered directly via a retractable power cord.

Spool 202 may be a single spool, a single spool with a divider, or a dual-spool configuration. For example, according to the illustrated embodiment, spool 202 may include a divider 204 for separating first rope 184 and second rope 186 as they are wound on spool 202. Notably, because spool 202 is vertically mounted, apertures 196 may be positioned vertically at different levels in order to maintain the horizontal orientation of first rope 184 and second rope 186. It is desirable to keep first rope 184 and second rope 186 separated and in a substantially horizontal orientation to ensure uniform spooling of first rope 184 and second rope 186 and to minimize the possibility of tangling.

Although pulley systems 172, 176 are described as having three frame pulleys 179, 180, 181, two rack pulleys 182, 183, two ropes 184, 186, and one retracting means 200, one skilled in the art will appreciate that this configuration is used only for the purpose of explaining certain aspects of the present subject matter. Variations and modifications may be made to this configuration while remaining within the scope of the present subject matter. For example, more or fewer pulleys may be used, the first end of each rope may be attached at different locations on frame 170 or even to each other, alternative retracting means may be used, etc. Similarly, a single pulley system may be used, e.g., first pulley system 172 only, or two pulley systems 172, 176 may be used with entirely separate and dedicated retracting means 200. Indeed, any system configured for moving lower rack 128 vertically within frame 170 may be used.

As explained above, first rope 184 may pass from third frame pulley 181 through aperture 196 in front 198 of frame 170. According to the illustrated embodiment, aperture 196 may have a friction reducing bushing 206 located therein to allow first rope 184 to slide with reduced friction, thereby lowering the likelihood of fraying or other wear and reducing the force required to pull first rope 184. One skilled in the art will appreciate that this configuration is only one exemplary manner of passing ropes 184, 186 between pulley systems 172, 176 to retracting means 200. According to an alternative embodiment, a horizontally-oriented pulley may be positioned within frame 170 to reduce resistance. More specifically, the horizontally-oriented pulley may be placed in the same horizontal plane as retracting means 200 and third frame pulley 181. The horizontally-oriented pulley may be positioned within aperture 196 or on the front 198 of frame 170.

The components of pulley systems 172, 176 may be made from any suitably rigid material. For example, pulleys 179, 180, 181, 182, 183 may be made from plastic, aluminum, or any other suitable material. Pulleys 179, 180, 181, 182, 183 may be mounted to lower rack 128 and frame 170 using any suitable method, e.g., using bearings or bush bearings. First rope 184 and second rope 186 may be made from any suitably flexible material having low stretch along its longitudinal direction. For example, ropes 184, 186 may be cables, strings, cords, etc. Similarly, ropes 184, 186 may be made from various materials. According to the illustrated embodiment, ropes 184, 186 may be made from stainless steel. However, according to alternative embodiments, materials such as cotton, Kevlar, or nylon may be used.

According to the illustrated exemplary embodiment, rack lifting assembly 130 may further include one or more slide assemblies. Slide assemblies may refer to any mechanical device for ensuring that lower rack 128 stays in a level, horizontal orientation as it is lifted. Particularly when articles are placed within lower rack 128 in an unbalanced manner, lower rack 128 may have a tendency to rotate and bind within frame 170 or topple altogether. Slide assemblies are configured to prevent this undesirable rotation and ensure smooth uniform movement of lower rack 128 within frame 170.

According to the illustrated embodiment, rack lifting assembly 130 may include a first linear slide assembly 210 and a second linear slide assembly 212 which are mounted on opposing sides of lower rack 128 to prevent tilting of lower rack 128 during lifting. More particularly, first linear slide assembly 210 is positioned proximate to first side 174 of lower rack 128 and second linear slide assembly 212 is positioned proximate to second side 178 of lower rack 128.

Figure 11:
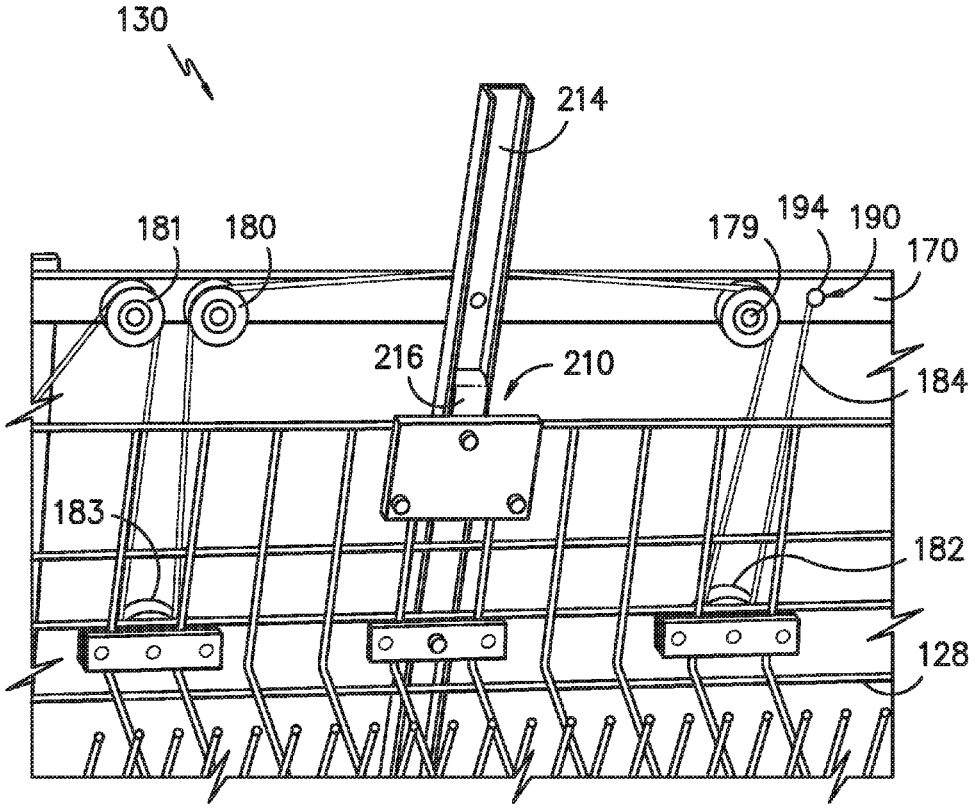
FIG. 11 provides a perspective view of a slide assembly of the exemplary rack lifting assembly of FIG. 3.

As best shown in FIG. 11, each slide assembly 210, 212 may include a guide 214 mounted to the left and right side of frame 170, respectively, and extending from a bottom portion of frame 170 along a vertical direction V to a top portion of frame 170. In addition, each slide assembly 210, 212 may include a slide 216 that is mounted to first side 174 and second side 178, respectively, of lower rack 128, and extending along a vertical direction V. Slide 216 may be configured for receipt in guide 214, e.g., via a suitable bearing arrangement. In this manner, slide 216 and guide 214 may move linearly relative to each other to ensure lower rack 128 moves uniformly and vertically within frame 170 without binding or tilting about the lateral direction L.

Each guide 214 and slide 216 may be attached to frame 170 and lower rack 128, respectively, using any suitable mechanical fastener, such as screws, bolts, rivets, etc. Alternatively, glue, snap-fit mechanisms, interference-fit mechanisms, or any suitable combination thereof may secure first linear slide assembly 210 and second linear slide assembly 212 in rack lifting assembly 130. One skilled in the art will appreciate that other slide assemblies may be used and such slide assemblies remain within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A dishwasher appliance defining a vertical, a lateral, and a transverse direction, the dishwasher appliance comprising:

a wash tub that defines a wash chamber;

a fluid circulation assembly for providing a fluid flow for cleaning articles placed within the wash chamber; and a lower rack lifting assembly comprising:

a frame slidably positioned within the wash chamber and configured for movement along the transverse direction between a first position where the frame is within the wash chamber and a second position where the frame is positioned outside the wash chamber;

a lower rack configured for receipt of the articles for washing;

a first set of pulleys rotatably mounted to the frame;

a second set of pulleys rotatably mounted to the lower rack;

a rope passing between the first set of pulleys and the second set of pulleys to operably couple the lower rack to the frame, the rope having a first end fixed to the frame and an opposite second end; and a retracting means configured for retracting the second end of the rope to move the lower rack vertically within the frame.

2. The dishwasher appliance of claim 1, wherein the first set of pulleys and the second set of pulleys are positioned at a first lateral side of the lower rack and the rope is a first rope, and wherein the rack lifting assembly further comprises:

a third set of pulleys rotatably mounted to the frame at a second lateral side of the lower rack;

a fourth set of pulleys rotatably mounted to the lower rack at the second lateral side of the lower rack; and a second rope passing between the third set of pulleys and the fourth set of pulleys to operably couple the lower rack to the frame, the second rope having a first end fixed to the frame and an opposite second end, wherein the retracting means is configured for retracting the second end of the second rope to move the lower rack vertically within the frame.

3. The dishwasher appliance of claim 2, wherein the retracting means is a manual pull bar attached to the second end of the first rope and the second end of the second rope.

4. The dishwasher appliance of claim 2, wherein the retracting means is a motor attached to the frame, the motor being configured to rotate a first spool that receives the first rope and a second spool that receives the second rope to wind and unwind the first rope and the second rope such that the lower rack moves in the vertical direction within the frame.

5. The dishwasher appliance of claim 4, wherein the motor is an electric motor.

6. The dishwasher appliance of claim 4, wherein the motor is a hydraulic motor.

7. The dishwasher appliance of claim 1, wherein the rack lifting assembly further comprises a slide assembly, the slide assembly slidably coupling the lower rack and the frame to allow the lower rack to remain horizontal while moving in the vertical direction within the frame.

8. The dishwasher appliance of claim 7, wherein the slide assembly comprises a slide fixed to the lower rack and a guide fixed to the frame such that the slide may be received in the guide.

9. The dishwasher appliance of claim 1, further comprising a set of wheels rotatably mounted to the frame such that the frame may roll into and out of the wash chamber.

10. The dishwasher appliance of claim 1, wherein the first set of pulleys comprises three pulleys and the second set of pulleys comprises two pulleys.

11. The dishwasher appliance of claim 1, wherein the rope is made of stainless steel.

* * * * *